US006442369B1

(12) United States Patent
Swartz et al.

(10) Patent No.: US 6,442,369 B1
(45) Date of Patent: Aug. 27, 2002

(54) AIR BEARING MECHANISM FOR FLATTENING PAPER IN A PRINTING MACHINE

(75) Inventors: Lars-Erik Swartz, Sunnyvale; David Kalman Biegelsen, Portola Valley, both of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/721,679

(22) Filed: Nov. 27, 2000

(51) Int. Cl.[7] ..... G03G 15/00
(52) U.S. Cl. ..... 399/388; 399/390
(58) Field of Search ..... 219/216; 399/107, 399/121, 122, 297, 303, 304, 305, 388, 390

(56) References Cited

U.S. PATENT DOCUMENTS

| | | | | |
|---|---|---|---|---|
| 4,959,693 A | * | 9/1990 | Mitsuya et al. | 399/388 |
| 5,235,393 A | * | 8/1993 | Merle | 219/216 |
| 5,467,111 A | * | 11/1995 | Furukawa et al. | 346/134 |
| 5,913,268 A | | 6/1999 | Jackson et al. | 101/420 |

* cited by examiner

*Primary Examiner*—Hoang Ngo
(74) *Attorney, Agent, or Firm*—Perman & Green, LLP

(57) ABSTRACT

A device for enhancing the transport of sheets in a printing machine is constructed upstream of the image transfer station to flatten the paper against the transport belt or drum on which it is riding. An air cushion is generated by expelling pressurized air through an array of holes to provide an air bearing for the sheets as it travels in its transport path. The air cushion is designed to flatten the paper against the belt or drum.

16 Claims, 2 Drawing Sheets

AIR BEARING MECHANISM FOR FLATTENING PAPER IN A PRINTING MACHINE

BACKGROUND OF THE INVENTION

The invention relates generally to a color or monochrome reprographic printing system, and more particularly concerns apparatus for delivering the paper or other media to a photoconductive surface, offset printing roll, etc.

In an electrophotographic printing machine, a photoconductive member (often a photoreceptor belt) is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is treated with toner particles and is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated in a plurality of cycles for differently colored images and their respective complementarily colored toner. Each single color toner image is transferred to the copy sheet in superimposed registration with the prior toner image. Alternately, a plurality of images may be superimposed on the photoreceptor surface, and transferred simultaneously to the sheet. This creates a multi-layered toner image on the copy sheet. Thereafter, the multi-layered toner image is permanently affixed to the copy sheet creating a color copy. The developer material may be a liquid or a powder material.

Surface irregularities in the paper may be occur as the paper (copy media) travels through the machine. Such irregularities may be caused by the various rollers and belts which carry the paper through the printing or other machine processes. For example, irregularities could occur as side one is fused before transferring an image to side two, or because of the characteristics of the paper stock due to manufacturing, humidity, etc. In addition, misalignment, excessive force, etc. may create localized deformities in the copy paper. As a result, air gaps may form between the paper and the photoreceptor belt. Such gaps result in poor transfer of toner from the belt to the paper, which may, in turn, cause deletions or distortions in the printed copy.

It is a purpose of this invention to improve the delivery of the paper to the photoreceptive belt and throughout the printing machine to minimize the formation of surface deformatities, such as wrinkles, etc. and thereby improve the engagement of the paper to the photoreceptive belt. It is another purpose of this invention to accomplish the above purpose without adding further media-contacting elements to the print media path. It is a further purpose of this invention to enable self-alignment of the handling means to accommodate media of various thicknesses and to provide means to apply uniform forces to sheets with deep texture.

U.S. Pat. No. 5,913,268, which issued in 1999 to the same assignee of this application, discloses a roller element for use in a copy machine. The disclosure of this patent is incorporated herein by reference. The roller described in the '268 is a pneumatic roller having an internal chamber which is selectively connected to a source of fluid under pressure or a vacuum. Through holes in the exterior periphery of the roller, copy paper, which is being handled by the roller, may be selectively subjected to pressure or vacuum. This is said to improve the paper handling performance of the transport system. It is a purpose of this invention to adapt the pneumatic roller concept to enhance the delivery of copy paper to an image transfer station.

SUMMARY OF THE INVENTION

In the method and apparatus of this invention, a bearing surface of constant shape is constructed to provide a cushion of air between the print medium and the moving supporting surface. The air cushion causes a downward pressure to hold the medium to the transport element, i.e. a belt or drum, as the media is moved towards the image transfer station or other process station of the printing machine. The air bearing surface is positioned just upstream from the image transfer station to minimize distortion of the media as it is transferred to the electrostatic belt or drum.

To accomplish this, a housing is constructed just upstream of the image transfer station, adjacent the transport element. The housing contains a plenum for storing air under pressure. The housing has an exterior wall, the outer surface of which faces the path of the copy paper to form a bearing surface. The bearing surface is constructed to conform to the shape of the transport element. For example, a belt would generally require a flat bearing surface and a drum may require a slightly arcuate bearing surface.

The plenum is connected to a source of pressurized air through a series of valves. Sensors within the plenum monitor the pressure in the plenum and control the supply of air through the valves. An array of holes are constructed in the exterior wall to allow streams of pressurized air to escape to lubricate and form the bearing surface. The streams of pressurized air form a cushion outside the exterior wall to separate the copy paper from the wall and generate an overall pressure against the paper to encourage its flat engagement with the transport element. A flat, well aligned, presentation of the copy paper to the image transfer station may then be accomplished without supplementary transport elements which rely on physical contact.

DESCRIPTION OF THE DRAWING

The invention is described in more detail below with reference to the attached drawing in which.

DETAILED DESCRIPTION OF THE INVENTION

Figure 1:
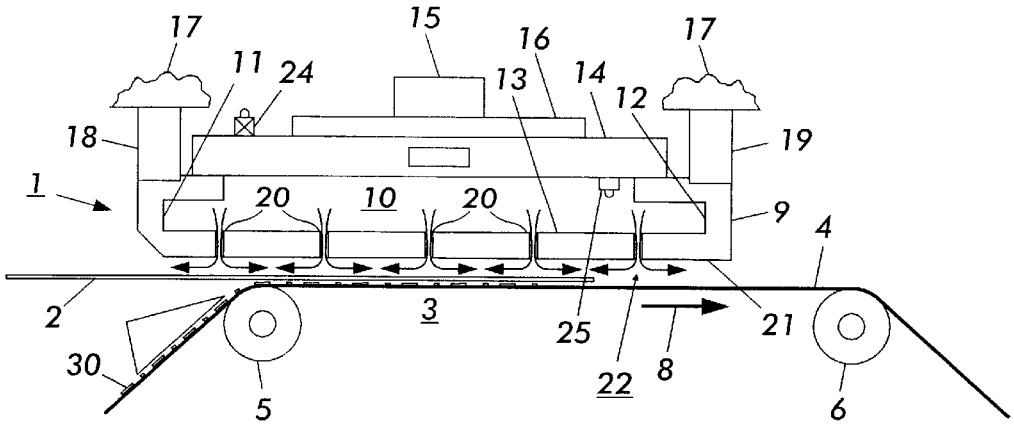
FIG. 1 is a schematic diagram of the air bearing transport element of this invention.

In the schematic diagram of FIG. 1, an air bearing transport element 1 is depicted as part of a paper transport system of a copy machine. This portion of the transport system could be just upstream of an image transfer station at which paper alignment and flatness is critical. The air bearing transport element 1 could also be useful immediately prior to the heating station at which the paper is heated by the fuser roll. This invention could also be used in printers and other paper handling environments. Although it will be described in the context of handling copy paper in a copier, it would be equally advantageous in the handling of other copy or print media.

The transport element 1 is positioned adjacent to the path of copy paper 2 at a point where copy paper 2 is being transported into or through image transfer station 3 on transport belt 4. As shown in FIG. 1, air bearing 1 is positioned partially over support roller 5 to engage the paper prior to contact with the belt 4. In this case belt 4 is a photoreceptor element and contains the toner image 30. Transport belt 4 is mounted for movement on driven rollers or pulleys 5 and 6, as shown by arrows 7 and 8. Transport element 1 is constructed of a housing 9 in which a plenum 10 is defined by side walls 11 and 12 and exterior wall 13. An air diffuser 14 acts as a cover to seal the plenum and a bracket to support fan 16 which is driven by motor 15. The housing is resiliently supported by the frame of the copy machine 17 through springs 18 and 19 or other resilient elements which are capable of reducing vibration and allowing alignment of the housing 9 with transport belt 2.

Pressurized air may be supplied by a fan 15, as shown, or other suitable blower or compressor. The source of pressurized air charges plenum 10 during operation of the copy machine. An array of openings 20 are constructed in the exterior wall 13 of the housing 9 to allow air to escape from plenum 10 and coat the exterior surface 21 to form a bearing surface 22. Bearing surface 22 spreads between the paper 2 and the exterior surface 21 of housing 9 to force the paper 2 towards belt 4. This action tends to flatten the paper 2, as it makes initial contact to the photoreceptor or transfer roll of an offset press, as shown in FIG. 1. Such action will also tend to hold it more firmly to the support surface of belt 4 as it moves towards the image transfer station 3. The image formed by the toner on the photoreceptor belt is generally shielded from infiltrating air currents originating at the air bearing surface 22 by means of a skimmer. In addition paper 2 will block air from blowing directly on the toner image. An air current of significant velocity is thereby avoided that might dislodge the toner which is electrostatically bonded to the photoreceptor.

Exterior surface 21 may be shaped to conform to the opposing surface of transport element 4. This would be advantageous in the case of the transport element 4 being a drum instead of the belt as shown.

An appropriate control system for the air supply may include a release valve 24 and a sensor 25 to prevent the accumulation of excessive pressure. In addition the pressurized air supply could be located remote from the housing 9 and communicate through a flexible hose. Air flow would be controlled by a valve which would be opened and closed by signals from the main copier process controller or by feeding back to a voltage controllable pressure source.

Figure 2:
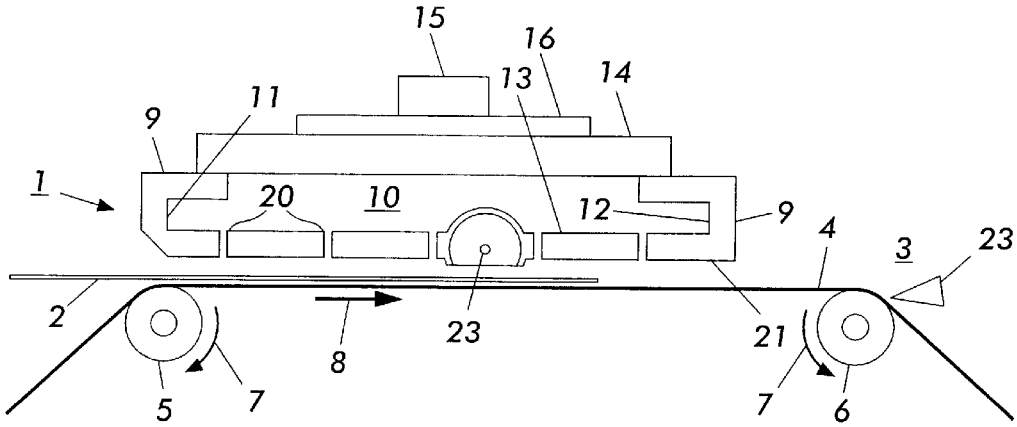
FIG. 2 is a schematic diagram of a first alternate embodiment of the air bearing transport element of this invention.
Figure 3:
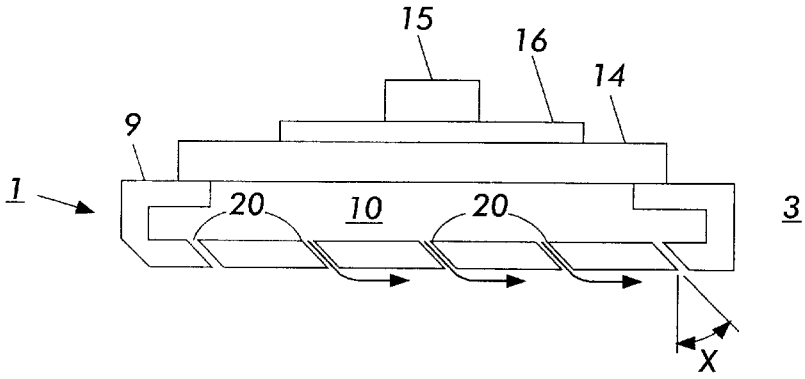
FIG. 3 is a schematic diagram of a second alternate embodiment of the air bearing transport element of this invention.

In a first alternate embodiment, as shown in FIG. 2, a device, i.e. corotron 23, for electrostatically charging the copy medium to assist in the transfer of toner is mounted in housing 9.

In a second alternate embodiment, at least a portion of the array of holes 20 are canted forward at an angle x of about 45° to the direction of paper travel. This generates components of force which tenter or stretch the sheet, thereby, tending to further flatten any buckles. Upstream of the position where the sheet 2 contacts the photoreceptor, the canted holes 20 assist sheet transport without the need to use driver rollers.

Figure 4:
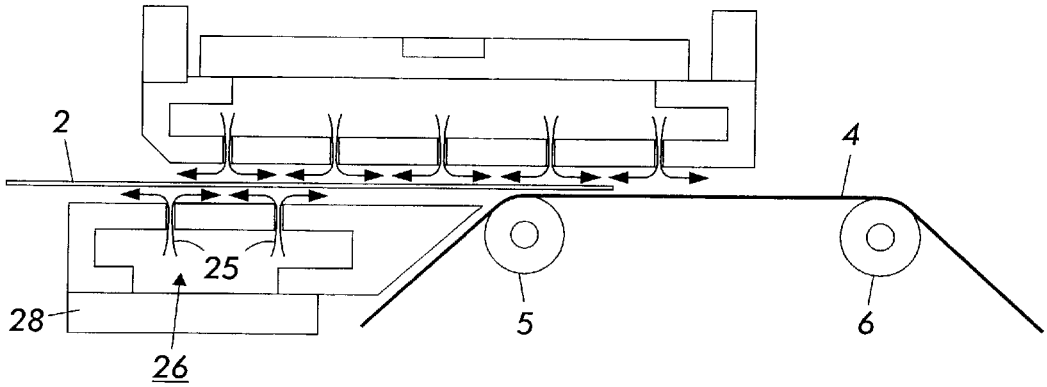
FIG. 4 is a schematic diagram of a third alternate embodiment of the supplementary transport element of this invention.

Another alternate embodiment is shown in FIG. 4. In this system a double surface of air is generated by positioning a second air bearing plenum 26 under plenum 10 and transporting the paper between the two bearing surfaces. A fan 28 or other source of pressurized air supplies air to plenum 26. Holes 27 in plenum 26 allow air to escape and form a support surface for sheet 2. The dual air bearing surface is positioned before sheet 2 makes contact with the photoreceptor. This configuration provides enhanced flattening of sheet 2 while fully supporting sheet 2 without physical contact. This is particularly useful when a previously toned image exists on the top side of sheet 2.

We claim:

1. A device for supplementing the transport of sheets of print media on a transport element of a printing machine in a predetermined path, wherein said printing machine includes an image transfer station mounted in the machine in the path of said print media to which the image is to be transferred; said supplemental transfer device comprising:

a transport element constructed in advance of said image transfer station to deliver said print media to said image transfer station in a predetermined path and direction;

a first housing having side walls and an exterior wall which cooperate to define a first interior plenum, said first housing mounted adjacent to said transport element in said print media path with said exterior wall facing said transport element;

a first source of pressurized air communicating with said first plenum to supply said plenum with pressurized air; and a first array of holes constructed in said exterior wall of said first plenum to allow said pressurized air to escape therefrom to form a first air cushion at said exterior wall between said exterior wall and the print media, said first air cushion urging said print media into flat engagement with the transport element.

2. A device for supplementing the transport of sheets of print media on a transport element of a printing machine in a predetermined path, as described in claim 1, wherein said device is an electrographic printer.

3. A device for supplementing the transport of sheets of print media on a transport element of a printing machine in a predetermined path, as described in claim 1, wherein said device is a sheet fed offset press.

4. A device for supplementing the transport of sheets of print media on a transport element of a printing machine in a predetermined path, as described in claim 1, wherein the source of air is a fan mounted on the housing.

5. A device for supplementing the transport of sheets of print media on a transport element of a printing machine in a predetermined path, as described in claim 1, wherein the holes are canted so that the air escapes with a component of force in the direction of said print mediapath.

6. A device for supplementing the transport of sheets of print media on a transport element of a printing machine in a predetermined path, as described in claim 1, wherein the holes are arranged to generate components of force in opposing orientations to tenter said sheets.

7. A device for supplementing the transport of sheets of print media on a transport element of a printing machine in a predetermined path, as described in claim 1, wherein said housing is mounted on the printing machine by means of a resilient mounting element.

8. A device for supplementing the transport of sheets of print media on a transport element of a printing machine in a predetermined path, as described in claim 1, wherein said resilient mounting element is a series of springs.

9. An electrophotographic printing machine in which a print medium is transported to an image transfer station by a transport element, comprising:

an image transfer station mounted in the machine in the path of said print medium to which the image is to be transferred;

a transport element constructed in advance of said image transfer station to deliver said print medium to said image transfer station in a predetermined path and direction;

a first housing having side walls and an exterior wall which cooperate to define a first interior plenum, said first housing mounted adjacent to said transport element in said print media path with said exterior wall facing said transport element;

a first source of pressurized air communicating with said first plenum to supply said first plenum with pressurized air; and an array of holes constructed in said exterior wall of said first plenum to allow pressurized air to escape therefrom to form a first air cushion at said exterior wall between said exterior wall and the print medium, said air cushion urging said print medium into flat engagement with said transport element.

10. An electrophotographic printing machine in which a print medium is transported to an image transfer station by a transport element, as described in claim 9, wherein an electrostatic tacking element is mounted on the housing adjacent to said print media path to generate a charge on said paper which tends to attract said paper to said transport element.

11. An electrophotographic printing machine in which a print medium is transported to an image transfer station by a transport element, as described in claim 9, wherein the source of air is a fan mounted on the housing.

12. An electrophotographic printing machine in which a print medium is transported to an image transfer station by a transport element, as described in claim 10, wherein the holes are canted so that the air escapes with a component of force in the direction of said print media path.

13. An electrophotographic printing machine in which a print medium is transported to an image transfer station by a transport element, as described in claim 9, wherein said housing is mounted on the printing machine by means of a resilient mounting element.

14. An electrophotographic printing machine in which a print medium is transported to an image transfer station by a transport element, as described in claim 13, wherein said resilient mounting element is a series of springs.

15. An electrophotographic printing machine in which a print medium is transported to an image transfer station by a transport element, as described in claim 9, further comprising:

a second housing having side walls and an exterior wall which cooperate to define an interior plenum, said second housing mounted opposite to said first housing with said exterior wall of said second housing facing said exterior wall of said first housing and wherein said path of said print medium passes in between;

a second source of pressurized air communicating with said second plenum to supply said second plenum with pressurized air; and a second array of holes constructed in said exterior wall of said second housing to allow pressurized air to escape therefrom to form a second air cushion at said exterior wall of said second housing between said exterior wall and the print medium, said first and second air cushions supporting said print medium there between.

16. A device for supplementing the transport of sheets of print media on a transport element of a printing machine in a predetermined path comprising:

a first housing having side walls and an exterior wall which cooperate to define a first interior plenum, said first housing mounted adjacent to said transport element in said print media path with said exterior wall facing said transport element;

a first source of pressurized air communicating with said first plenum to supply said plenum with pressurized air;

a first array of holes constructed in said exterior wall of said first plenum to allow said pressurized air to escape therefrom to form a first air cushion at said exterior wall between said exterior wall and the print media, said first air cushion urging said print media into flat engagement with the transport element; and an electrostatic transfer element mounted on the housing adjacent to said print media path to generate a charge on said print media to assist transfer of toner from belt to print media.

* * * * *